US007218043B2

(12) United States Patent
Hong et al.

(10) Patent No.: US 7,218,043 B2
(45) Date of Patent: May 15, 2007

(54) PLASMA DISPLAY PANEL WITH LIGHT GUIDES FOR IMPROVING CONTRAST

(75) Inventors: Chang-Wan Hong, Yongin-si (KR); Yung-Jun Park, Yongin-si (KR); Young-Sun Kim, Suwon-si (KR); Young-Soo Han, Suwon-si (KR); Jong-Sul Min, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/046,748

(22) Filed: Feb. 1, 2005

(65) Prior Publication Data

US 2005/0236949 A1 Oct. 27, 2005

(30) Foreign Application Priority Data

Apr. 27, 2004 (KR) ..... 10-2004-0029176

(51) Int. Cl.
*H01J 61/40* (2006.01)

(52) U.S. Cl. ..... 313/110; 313/111; 313/112; 313/113; 313/114; 313/582; 313/586; 313/587; 313/584

(58) Field of Classification Search ..... 313/582–587, 313/559, 561, 614, 110, 111, 112, 113, 114, 313/537; 349/62–63, 65; 389/146; 345/37, 345/41, 60, 71; 315/169.4, 169.1; 362/561, 362/559, 614

See application file for complete search history.

(56) References Cited

U.S. PATENT DOCUMENTS

| | | | | |
|---|---|---|---|---|
| 5,608,286 | A * | 3/1997 | Levine et al. | 313/495 |
| 5,939,826 | A * | 8/1999 | Ohsawa et al. | 313/582 |
| 6,603,446 | B1 * | 8/2003 | Kanazawa et al. | 345/60 |
| 6,621,217 | B2 * | 9/2003 | Nishiki et al. | 313/587 |
| 2002/0097358 | A1 * | 7/2002 | Ueki et al. | 349/113 |
| 2004/0095296 | A1 * | 5/2004 | Kojima et al. | 345/60 |
| 2005/0052844 | A1 * | 3/2005 | McCollum et al. | 361/689 |

FOREIGN PATENT DOCUMENTS

| | | |
|---|---|---|
| EP | 1189292 | 3/2002 |
| JP | 04-298936 | 10/1992 |
| JP | 05-080319 | 4/1993 |
| JP | 07-036395 | 2/1995 |
| JP | 09-55168 | 2/1997 |
| JP | 10-214567 | 8/1998 |
| JP | 11-259006 | 9/1999 |
| JP | 11-260269 | 9/1999 |
| KR | 10-1998-061408 | * 10/1998 |
| KR | 1998061408 A | * 10/1998 |
| KR | 1999-70801 | 9/1999 |
| KR | 2001-3684 | 1/2001 |

* cited by examiner

OTHER PUBLICATIONS

PCT Int'l Search Report PCT/KR2005/001145.

*Primary Examiner*—Joseph Williams
*Assistant Examiner*—Hana A. Sanei
(74) *Attorney, Agent, or Firm*—Roylance, Abrams, Berdo & Goodman, LLP

(57) ABSTRACT

Disclosed is a plasma display panel. The plasma display panel comprises a lower substrate and an upper substrate, which are spaced apart by a predetermined distance from each other to define a plurality of discharge cells therebetween; a plurality of barrier ribs disposed between the lower substrate and the upper substrate; a plurality of address electrodes formed in parallel with one another on an upper surface of the lower substrate; a plurality of discharge electrodes formed in a direction crossing the address electrodes on a lower surface of the upper substrate; and a fluorescent layer formed on an inner wall of the discharge cells, wherein the upper substrate comprises a plurality of light guides, which are formed in parallel with the plurality of address electrodes to focus and output visible light generated from the discharge cells by a discharge, the light guides having a light incident surface.

21 Claims, 11 Drawing Sheets

PLASMA DISPLAY PANEL WITH LIGHT GUIDES FOR IMPROVING CONTRAST

CROSS-REFERENCE TO RELATED APPLICATIONS

This application claims the benefit under 35 U.S.C. §119 (a) of Korean Patent Application No. 10-2004-0029176, filed on Apr. 27, 2004, in the Korean Intellectual Property Office, the entire disclosure of which is incorporated herein by reference.

BACKGROUND OF THE INVENTION

1. Field of the Invention

The present invention relates to a plasma display panel. More particularly, the present invention relates to a plasma display panel with an improved structure that can enhance brightness and bright room contrast.

2. Description of the Related Art

A plasma display panel (PDP) is an apparatus that forms an image using an electrical discharge, and has superior display performances in brightness and viewing angle. In such a PDP, a DC or AC voltage applied to electrodes causes a gas discharge between the electrodes, and ultraviolet rays generated during the gas discharge excites phosphors, so that visible light is emitted from the excited fluorescent material.

The PDP can be classified into either a DC type PDP or an AC type PDP according to the type of gas discharge. The DC type PDP has a structure in which all electrodes are exposed to a discharge space and charges move directly between the electrodes. The AC type PDP has a structure in which at least one electrode is covered with a dielectric layer, and charges do not move directly between the corresponding electrodes but discharge is performed by wall charges.

Alternatively, the PDP may be classified into either a facing discharge type PDP or a surface discharge type PDP according to the arrangement structure of the electrodes. The facing discharge type PDP has a structure in which two sustaining electrodes forming a pair are formed respectively on a lower substrate and an upper substrate, and a discharge occurs in a direction perpendicular to the substrate. The surface discharge type PDP has a structure in which two sustaining electrodes forming a pair are respectively formed on the same substrate, and a discharge occurs in a direction parallel to the substrate.

The facing discharge type PDP has a high luminous efficiency, but it has also a disadvantage in that the fluorescent phosphor layer is easily degenerated. To this end, at present, the surface discharge type PDP is mainly used.

FIGS. 1 and 2 show a construction of a general surface discharge type PDP. Particularly, FIG. 2 shows that only an upper substrate of the surface discharge type PDP is rotated by 90 degrees for easier understanding of an inner structure of the PDP.

Referring to FIGS. 1 and 2, the conventional PDP includes a lower substrate 10 and an upper substrate 20 facing each other.

On an upper surface of the lower substrate 10, a plurality of address electrodes 11 are arranged in a stripe configuration. The address electrodes 11 are buried by a first dielectric layer 12. On the first dielectric layer 12, a plurality of barrier ribs 13 are formed spaced away by a predetermined distance from one another so as to prevent electrical and optical cross-talk between discharge cells 14. The inner surfaces of discharge cells 14 are partitioned by the barrier ribs 13 and are coated with a predetermined thickness of a red (R), green (G) and blue (B) fluorescent layer 15. Inside the discharge cells 14, a discharge gas is filled. The discharge gas is a mixture gas of neon (Ne) gas and a small amount of xenon (Xe) gas, which is generally used for a plasma discharge.

The upper substrate 20 is a transparent substrate through which visible light passes, and is formed mainly of glass. The upper substrate 20 is coupled with the lower substrate 10 having the barrier ribs 13. On a lower surface of the upper substrate 20, sustaining electrodes 21*a* and 21*b* forming pairs and perpendicularly crossing the address electrodes 11 are arranged in a stripe configuration. The sustaining electrodes 21*a* and 21*b* are formed of a transparent conductive material such as indium tin oxide (ITO) such that the visible light can pass through the sustaining electrodes 21*a* and 21*b*. In order to reduce a line resistance of the sustaining electrodes 21*a* and 21*b*, bus electrodes 22*a* and 22*b* formed of a metal are formed beneath the respective sustaining electrodes 21*a* and 21*b* at a width less than that of the sustaining electrodes 21*a* and 21*b*. These sustaining electrodes 21*a* and 21*b* and the bus electrodes 22*a* and 22*b* are covered with a second dielectric layer 23. Beneath the second dielectric layer 23, a protective layer 24 is formed. The protective layer 24 prevents the second dielectric layer 23 from being damaged due to a sputtering of plasma particles and emits secondary electrons, thereby lowering the discharge voltage. The protective layer 24 is generally formed of magnesium oxide (MgO). Meanwhile, a plurality of black stripes 30 are formed spaced away by a predetermined distance from one another in parallel with the sustaining electrodes 21*a* and 21*b* on an upper surface of the upper substrate 20 so as to prevent light from being introduced into the panel from the exterior.

The operation of the conventional PDP constructed as above is generally classified into an operation for an address discharge and an operation for the sustaining discharge. The address discharge occurs between the address electrodes 11 and any one of the sustaining electrodes 21*a* and 21*b*, and during the address discharge, wall charges are formed. The sustaining discharge occurs due to a potential difference between the sustaining electrodes 21*a* and 21*b* positioned at the discharge cells 14 in which the wall charges are formed. During the sustaining discharge, the fluorescent layer 15 of the corresponding discharge cell is excited by ultraviolet rays generated from the discharge gas, so that visible light is emitted. When this visible light passes through the upper substrate 20, an image that is conceivable by a user is formed.

However, in the conventional PDP constructed as above, when the exterior is in a bright condition, namely, in a bright room condition, exterior light is introduced into the discharge cells 14, so that the introduced light overlaps the light generated from the discharge cells 14. As a result, the bright room contrast is lowered and thus the image display performance of the PDP is deteriorated.

SUMMARY OF THE INVENTION

The present invention provides a PDP that can enhance brightness and bright room contrast by improving a structure of an upper substrate.

According to an aspect of the present invention, there is provided a plasma display panel. The plasma display panel comprises a lower substrate and an upper substrate, which are spaced apart by a predetermined distance from each other to define a plurality of discharge cells therebetween; a plurality of barrier ribs disposed between the lower substrate and the upper substrate; a plurality of address electrodes formed in parallel with one another on an upper surface of the lower substrate; a plurality of discharge electrodes formed in a direction crossing the address electrodes on a lower surface of the upper substrate; and a fluorescent layer formed on an inner wall of the discharge cells, wherein the upper substrate comprises a plurality of light guides, which are formed in parallel with the plurality of address electrodes to focus and output visible light generated from the discharge cells by a discharge, the light guides having a light incident surface, which is larger in area than a light emitting surface thereof.

Each of the light guides may be formed corresponding to each of the discharge cells. Alternatively, the light guides may be at least two, which are formed corresponding to each of the discharge cells. Each of the light guides is formed corresponding to the two or more of the discharge cells. At this point, it is preferable that each of the light guides is formed corresponding to three of the discharge cells, the three discharge cells forming a unit pixel.

It is preferable that the upper substrate comprises an external light shielding member formed between the light guides, for preventing external light from being introduced into the discharge cells. The external light shielding member may comprise a conductive film for shielding Electro magnetic interference (EMI).

Also, it is preferable that the light emitting surfaces of the light guides be treated with a non-glare material.

The barrier ribs may be formed in parallel with the address electrodes.

Alternatively, a plurality of bus electrodes may be formed on lower surfaces of the discharge electrodes.

A first dielectric layer may be formed on an upper surface of the lower substrate to cover the address electrodes. A second dielectric layer may be formed on a lower surface of the upper substrate to cover the discharge electrodes. At this point, it is preferable that a protective layer be formed on a lower surface of the second dielectric layer.

According to another aspect of the present invention, there is provided a plasma display panel. The plasma display panel comprises a lower substrate and an upper substrate, which are spaced apart by a predetermined distance from each other to define a plurality of discharge cells therebetween; a plurality of barrier ribs disposed between the lower substrate and the upper substrate; a plurality of address electrodes formed in parallel with one another on an upper surface of the lower substrate; a plurality of discharge electrodes formed in a direction crossing the address electrodes on a lower surface of the upper substrate; and a fluorescent layer formed on an inner wall of the discharge cells, wherein the upper substrate includes a plurality of light guides, which are formed in a direction perpendicular to the plurality of address electrodes to focus and output visible light generated from the discharge cells by a discharge, the light guides having a light incident surface, which is larger in area than a light emitting surface thereof.

Each of the light guides may be formed corresponding to each of the discharge cells. Alternatively, the light guides may be at least two, which are formed corresponding to each of the discharge cells.

According to another aspect of the present invention, there is provided a plasma display panel. The plasma display panel comprises a lower substrate and an upper substrate, which are spaced apart by a predetermined distance from each other to define a plurality of discharge cells therebetween; a plurality of barrier ribs disposed between the lower substrate and the upper substrate; a plurality of address electrodes formed in parallel with one another on an upper surface of the lower substrate; a plurality of discharge electrodes formed in a direction crossing the address electrodes on a lower surface of the upper substrate; and a florescent layer formed on an inner wall of the discharge cells, wherein the upper substrate comprises a plurality of light guides, which are formed corresponding to the respective discharge cells to focus and output visible light generated from the discharge cells by a discharge, the light guides having a light incident surface, which is larger in area than a light emitting surface thereof.

The light guides may have a conical shape or a pyramidal shape. Also, it is preferable that the upper substrate comprises an external light shielding member formed between the light guides, for preventing an external light from being introduced into the discharge cells.

BRIEF DESCRIPTION OF THE DRAWINGS

The above and other features and advantages of the present invention will become more apparent by describing in detail exemplary embodiments thereof with reference to the attached drawings in which.

It should be understood that like reference numerals refer to like features, structures, and elements through out the drawings.

DETAILED DESCRIPTION OF EXEMPLARY EMBODIMENTS

The present invention will now be described more filly with reference to the accompanying drawings, in which exemplary embodiments of the invention are shown.

Figure 1:
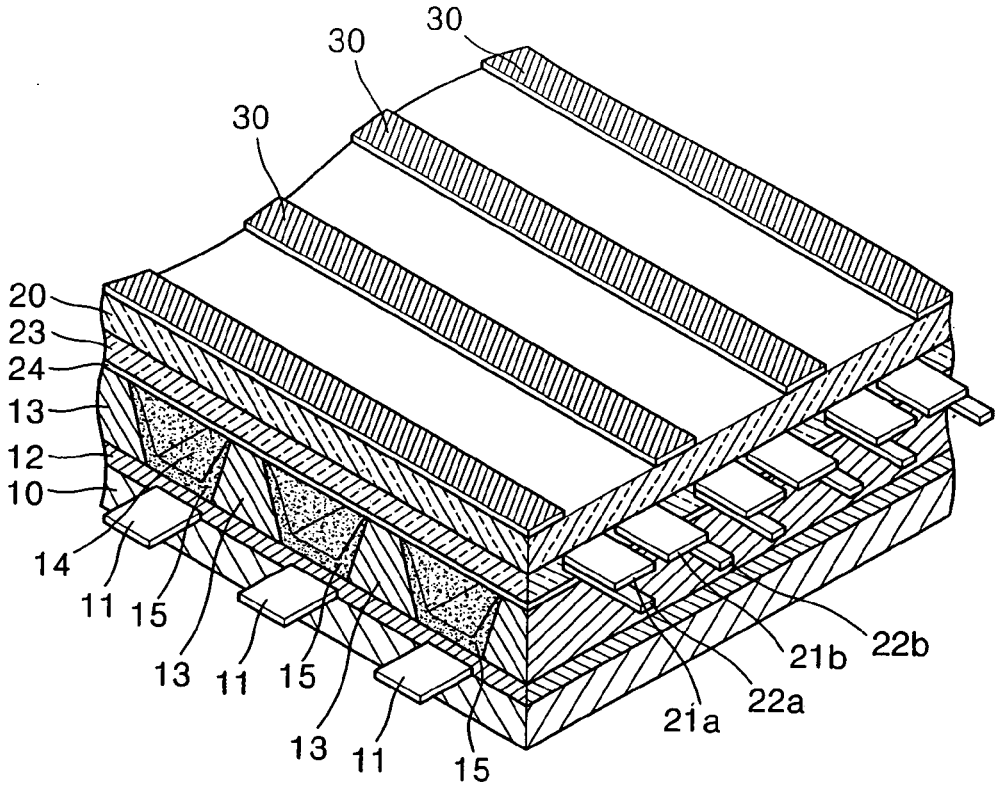
FIG. 1 (PRIOR ART)
FIG. 1 is a partial cut-away perspective view of a conventional PDP.
Figure 2:
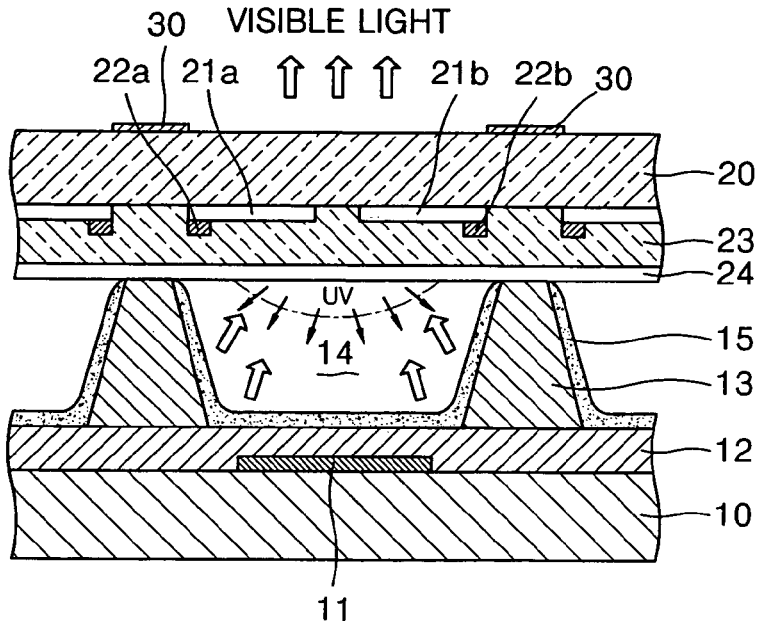
FIG. 2 (PRIOR ART)
FIG. 2 is a cross-sectional view illustrating an inner structure of the PDP of FIG. 1.
Figure 3:
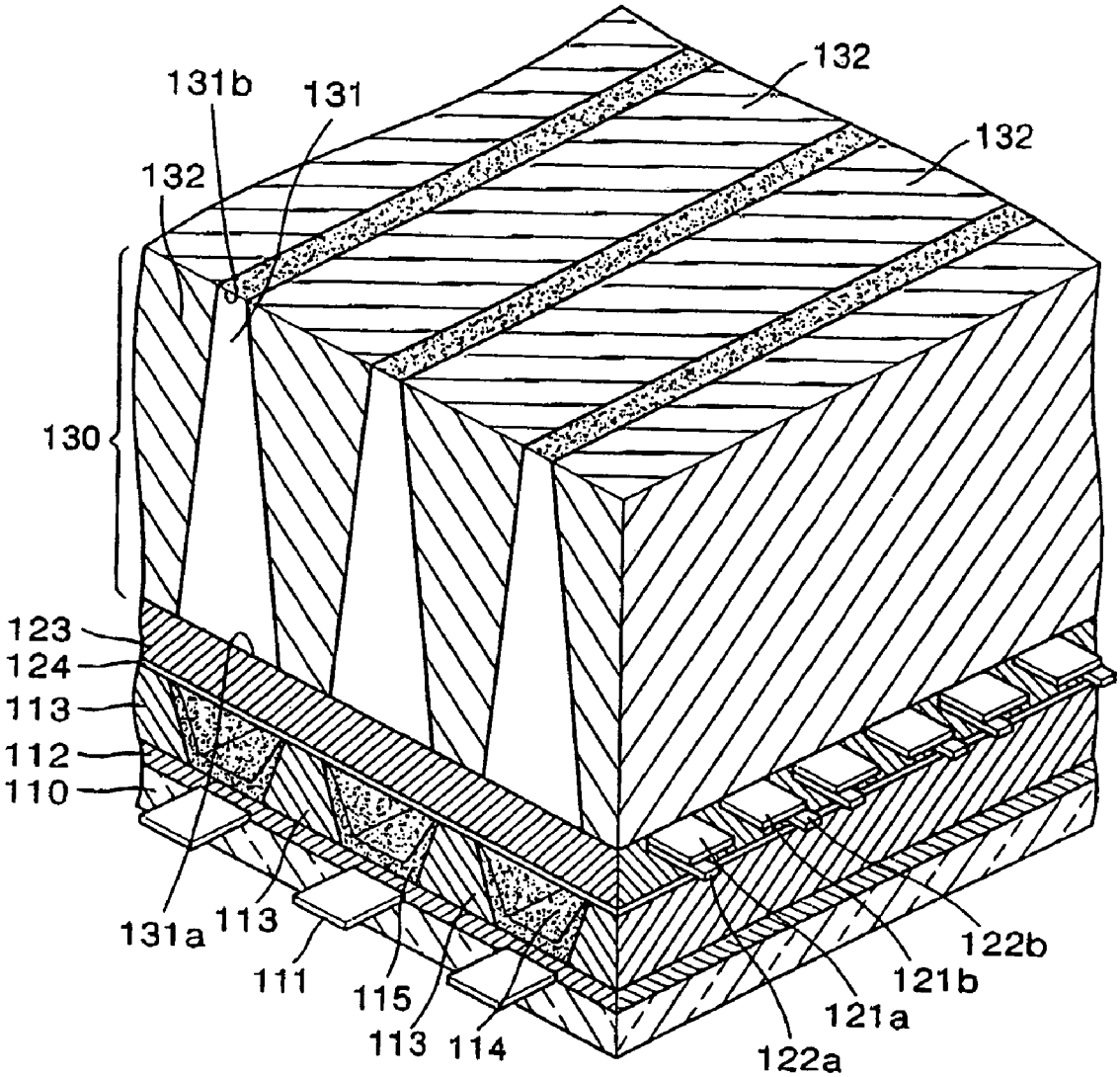
FIG. 3 is a partial cut-away perspective view of a PDP according to an embodiment of the present invention.
Figure 4:
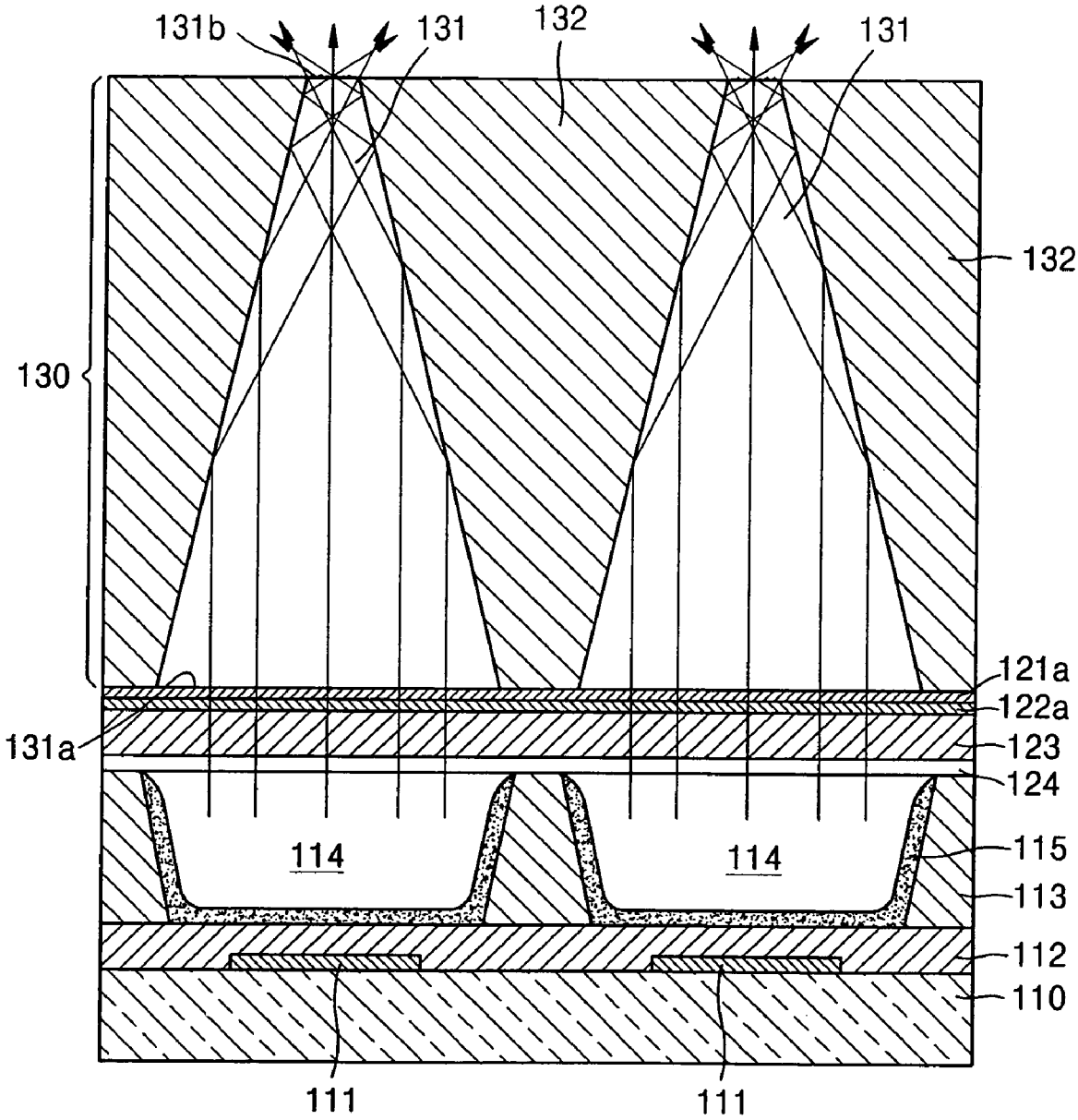
FIG. 4 is a cross-sectional view illustrating an inner structure of the PDP of FIG. 3.

FIG. 3 is a partial cut-away perspective view of a PDP according to an embodiment of the present invention, and FIG. 4 is a sectional view illustrating an inner structure of the PDP of FIG. 3.

Referring to FIGS. 3 and 4, the PDP comprises a lower substrate 10 and an upper substrate 130, which are spaced apart by a predetermined distance from each other. A plurality of discharge cells where plasma discharge occurs are formed between the lower substrate 110 and the upper substrate 130.

The lower substrate 110 is preferably formed of a glass substrate. A plurality of address electrodes are formed in parallel with one another in a stripe configuration on an upper surface of the lower substrate 110. A first dielectric layer 112 is formed to cover the address electrodes 111 and the lower substrate 110. The first dielectric layer 112 can be formed by depositing a preferably white dielectric material to a predetermined thickness.

A plurality of barrier ribs 113 are formed in parallel with the address electrodes 111 and spaced apart by a predetermined distance from the address electrodes 111 on an upper surface of the first dielectric layer 112. The barrier ribs 113 partition the discharge space between the lower substrate 110 and the upper substrate 130, thereby defining discharge cells 114. Also, the barrier ribs 113 function to prevent electrical and optical cross-talk between the adjacent discharge cells 1 14, thereby enhancing color purity. A red (R), green (G) and blue (B) fluorescent layer 115 is formed to a predetermined thickness on an upper surface of the first dielectric layer 112, and side surfaces of the barrier ribs 113 forming inner walls of the discharge cells 114. The fluorescent layer 115 is preferably excited by ultraviolet rays generated by a plasma discharge, thereby emitting visible light having a predetermined color. A discharge gas is filled inside the discharge cells 114. The discharge gas is preferably a mixture of neon (Ne) gas and a small amount of xenon (Xe) gas, which is typically used for plasma discharge.

The upper substrate 130 comprises a plurality of light guides 131, which are formed in parallel with the plurality of address electrodes 111 to focus and output visible light generated by a discharge. Each of the light guides 131 is formed corresponding to each of the discharge cells 114. Each of the light guides 131 is designed to reflect light from a surface thereof and to induce the light incident into a light incident surface 131 a to be emitted through a light emitting surface 131*b*. The light guides 131 have the light incident surface 131*a*, which is preferably larger in area than the light emitting surface 131*b*. An internal surface extends between the light incident surface 131*a* and the light emitting surface 131*b* to internally reflect light so as to focus and output the visible light generated in the discharge cells 114. By providing the light guides 131 having the above construction on the upper substrate 130, loss of visible light generated by the discharge can be reduced, thereby enhancing the brightness of the panel. Also, since the light guides 131 can be made at a width less than a few tens of jim, they can be employed in the resolution of XGA or SXGA level, thereby being capable of realizing a high definition image.

The light emitting surfaces 131*b* of the light guides 131 are preferably non-glare treated to prevent a dazzling phenomenon generated when external light is reflected by the light emitting surface 131*b* of the light guides 131.

The upper substrate comprises an external light shielding member 132 formed in parallel with the address electrodes 111 between the light guides 131, and prevents external light from being introduced into the discharge cells 114. Since the external light shielding member 132 is formed on a region of the upper substrate 130 other than a region through which visible light is emitted, the external light can be more effectively prevented from being introduced into the discharge cells 114 compared to the conventional art, thereby being capable of enhancing the bright room contrast. The external light shielding member 132 may comprise a conductive film for shielding electromagnetic interference (EMI).

First and second discharge electrodes 121*a* and 121*b* for sustaining a discharge are formed on a lower surface of the upper substrate 130 in a direction perpendicular to the address electrodes 111. The first and second discharge electrodes 121*a* and 121*b* are preferably made of a transparent conductive material, such as indium tin oxide (ITO), such that the visible light generated in the discharge cells 114 can be transmitted. First and second bus electrodes 122*a* and 122*b* are preferably formed of a metal material on lower surfaces of the first and second discharge electrodes 121*a* and 121*b*. The first and second bus electrodes 122*a* and 122*b* are used for reducing the line resistance of the first and second discharge electrodes 121*a* and 121*b*, and are preferably formed with a width narrower than that of the first and second discharge electrodes 121*a* and 121*b*.

A second dielectric layer 123 is formed on a lower surface of the upper substrate 130 so as to cover the first and second discharge electrodes 121*a* and 121*b* and the first and second bus electrodes 122*a* and 122*b*. The second dielectric layer 123 can preferably be formed by depositing a transparent dielectric material on the lower surface of the upper substrate 130 to a predetermined thickness.

A protective layer 124 is formed on a lower surface of the second dielectric layer 123. The protective layer 124 functions to prevent the second dielectric layer 123 and the first and second discharge electrodes 121*a* and 121*b* from being damaged due to sputtering of the plasma particles and from emitting secondary electrons, thereby lowering a discharge voltage. The protective layer 124 can preferably be formed by depositing a dielectric material, such as magnesium oxide (MgO), on a lower surface of the second dielectric layer 123 to a predetermined thickness.

In the PDP constructed as above, when an address discharge occurs between the address electrodes 111 and any one of the electrodes of the first and second discharge electrodes 121*a* and 121*b*, wall charges are formed. Thereafter, when an AC voltage is applied to the first and second discharge electrodes 121*a* and 121*b*, a sustaining discharge occurs inside the discharge cells 114 where the wall discharges are formed. The sustaining discharge generates ultraviolet rays from the discharge gases, and the generated ultraviolet rays excite the fluorescent layer 115, thereby generating visible light.

The visible light generated in each of the discharge cells 114 are focused onto the upper surface of the upper substrate 130 by the light guides 131, and are then diffused and emitted to the outside. Accordingly, loss of the visible light generated in the discharge cells 114 can be reduced, so that the brightness of the PDP is enhanced.

Also, since the external light shielding member 132 is provided between the light guides 131, external light can be effectively prevented from being introduced into the discharge cells 114, so that the bright room contrast is enhanced.

Figure 5:
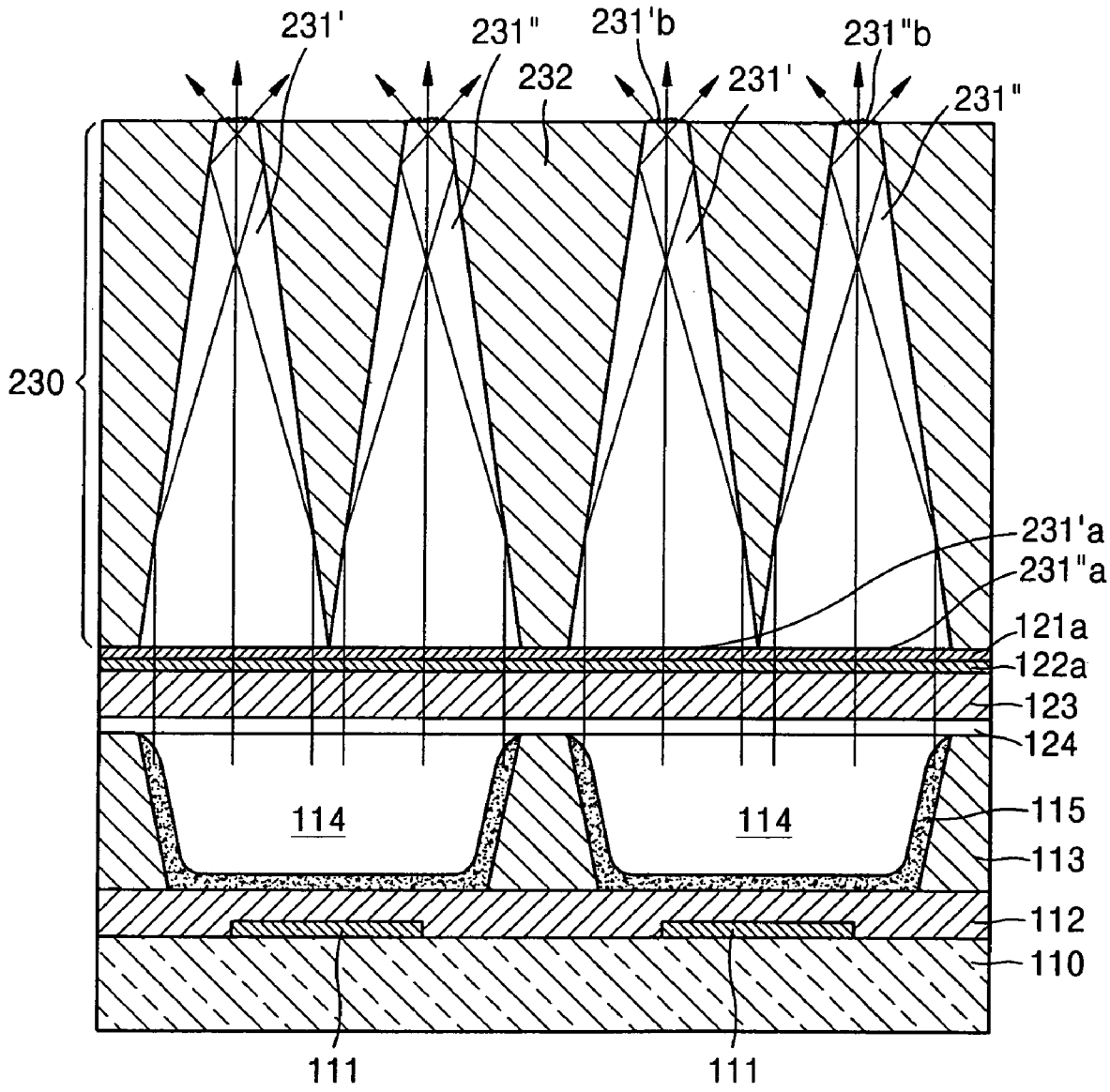
FIG. 5 is a cross-sectional view illustrating a modification of the PDP of FIG. 3.

FIG. 5 is a cross-sectional view illustrating a modification of the PDP of FIGS. 3 and 4. Referring to FIG. 5, two light guides 231' and 231" for focusing and outputting the visible light generated in the discharge cells 114 are formed corresponding to one discharge cell 114 in parallel with the address electrodes 111. The respective light guides 231' and 231" have light incident surfaces 231'*a* and 231"*a*, which are larger in area than light emitting surfaces 231'*b* and 231"*b*. Internal surfaces extend between the light incident surfaces 231'*a* and 231"*a* and light emitting surfaces 231'*b* and 231"*b* to internally reflect light. Although FIG. 5 shows and describes that two light guides 231' and 231" corresponding to one discharge cell 114 are formed, three or more light guides may be formed corresponding to one discharge cell 114. Preferably, the light emitting surfaces 231'*b* and 231"*b* of the light guides 231' and 231" are non-glare treated. Thus, if two or more light guides are formed corresponding to one discharge cell, loss of visible light generated in the discharge cells can be reduced and light integrity can be enhanced, thereby further enhancing the brightness of the panel.

An external light shielding member 232, which prevents external light from being introduced into the discharge cells 114, is formed between the light guides 231' and 231". Hence, the external light shielding member 232 can be formed on a wider area on the upper substrate 230 than that in the previous embodiment, so that the bright room contrast of the panel is further enhanced. The external light shielding member 232 can include a conductive film for shielding electromagnetic interference (EMI).

Figure 6:
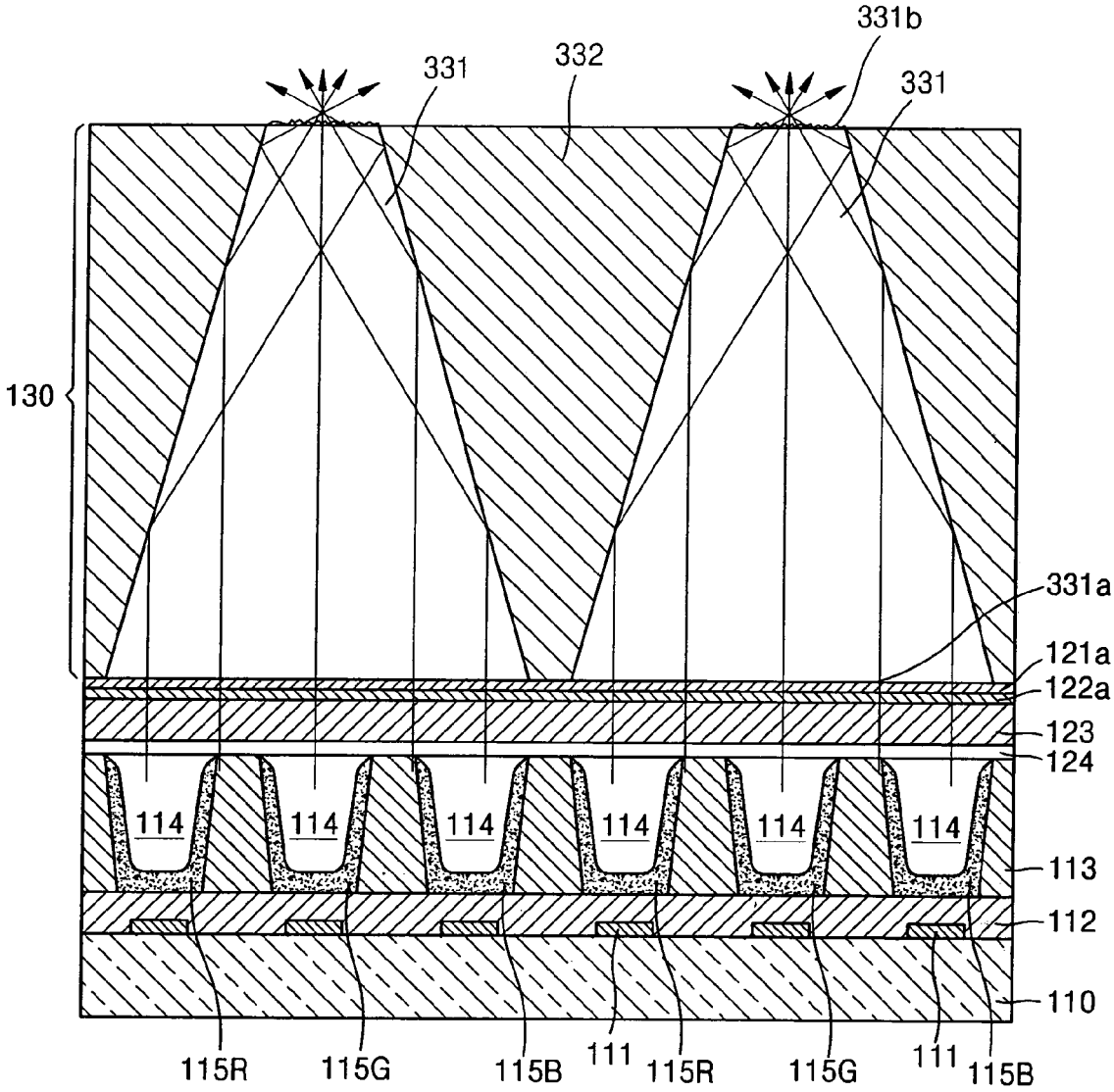
FIG. 6 is a cross-sectional view illustrating another modification of the PDP of FIG. 3.

FIG. 6 is a cross-sectional view illustrating another embodiment of the PDP of FIGS. 3 and 4. Referring to FIG. 6, each of light guides 331 is formed corresponding to two or more discharge cells 114 on an upper substrate 330. Each of the light guides 331 has a light incident surface 331*a*, which is larger in area than a light emitting surface 331*b*. An internal surface extends between the light incident surface 331*a* and the light emitting surface 331*b* to internally reflect light. It is preferable that each of the light guides 331 is formed corresponding to one pixel. In other words, it is preferable that each of the light guides 331 is formed corresponding to three discharge cells 114 in which red (R), green (G) and blue (B) fluorescent layers 115R, 115G, 115B are formed. Each of the light guides 331 focuses and outputs visible light generated from three discharge cells 114 in which red (R), green (G) and blue (B) fluorescent layers 115R, 115G, 115B are formed. The light emitting surfaces 331*b* of the light guides 331 are preferably non-glare treated. Thus, if each of the light guides 331 is formed corresponding to one pixel, brightness of the panel can be enhanced and processing of the light guides 331 is also enhanced, so that low price panels can be manufactured.

Additionally, an external light shielding member 332 for preventing external light from being introduced into the discharge cells 114 is formed between the light guides 331. Hence, the external light shielding member 332 can include a conductive film for shielding electromagnetic interference (EMI).

Figure 7:
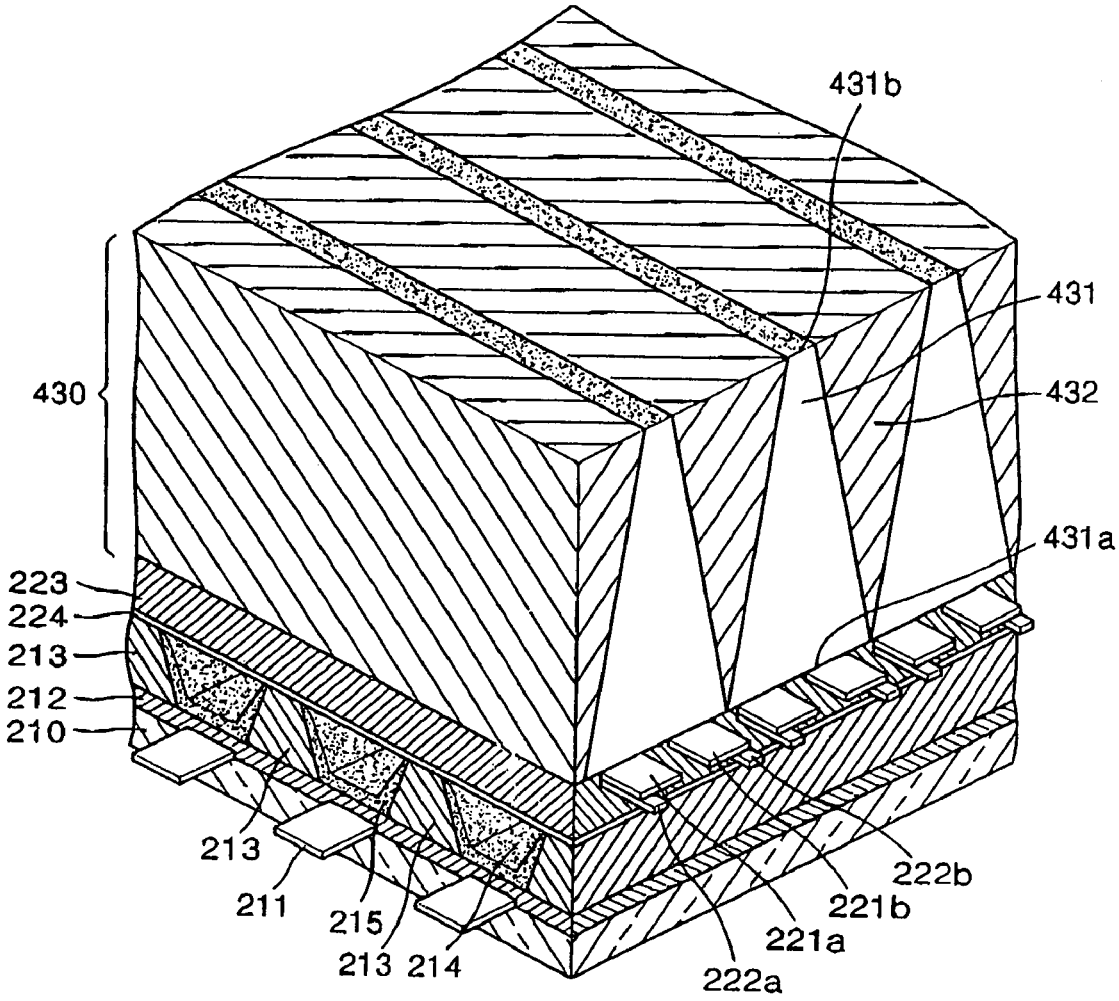
FIG. 7 is a partial cut-away perspective view of a PDP according to another embodiment of the present invention.
Figure 8:
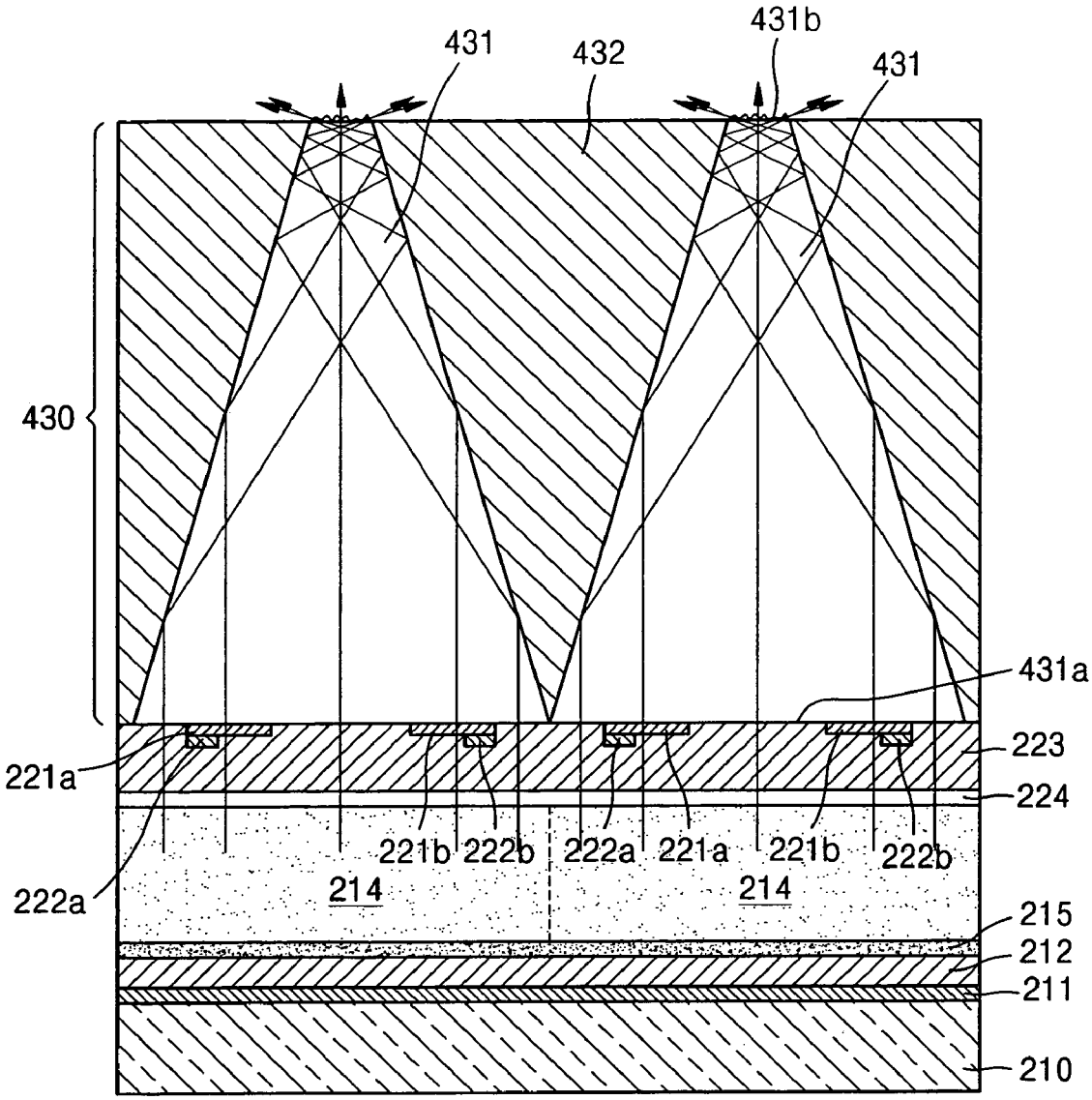
FIG. 8 is a cross-sectional view illustrating an inner structure of the PDP of FIG. 7.

FIG. 7 is a partial cut-away perspective view of a PDP according to another embodiment of the present invention, and FIG. 8 is a sectional view illustrating an inner structure of the PDP of FIG. 7.

Referring to FIGS. 7 and 8, a lower substrate 210 and an upper substrate 430 are spaced apart by a predetermined distance from each other, and a plurality of discharge cells 214 are formed between the lower substrate 210 and the upper substrate 430. A plurality of address electrodes 211 and a first dielectric layer 212 are preferably sequentially formed on an upper surface of the lower substrate 210. A plurality of barrier ribs 213 are formed in parallel with and spaced apart by a predetermined distance from the address electrodes 211 on an upper surface of the first dielectric layer 212. A fluorescent layer 215 is deposited on an upper surface of the first dielectric layer 212, and side surfaces of the barrier ribs 213 forming inner walls of the discharge cells 214. The discharge cells 214 are filled with a discharge gas.

Unlike in the above described embodiment, the upper substrate 430 comprises a plurality of light guides 431, which are formed in a direction perpendicular to the address electrodes 211 to focus and output visible light generated by a discharge. Each of the light guides 431 is formed corresponding to each of the discharge cells 214. Each of the light guides 431 is designed to reflect light from a surface thereof and to induce the light incident into a light incident surface 431*a* to be emitted through a light emitting surface 431*b*. The light guides 431 have the light incident surface 431*a*, which is larger in area than the light emitting surface 431*b*. An internal surface extends between the light incident surface 131*a* and the light emitting surface 131*b* to internally reflect light so as to focus and output the visible light generated in the discharge cells 214. By providing the light guides 431 having the above construction on the upper substrate 430, loss of the visible light generated by the discharge can be reduced, thereby enhancing the brightness of the panel.

The light emitting surfaces 431*b* of the light guides 431 are preferably non-glare treated to prevent a dazzling phenomenon from being generated when external light is reflected by the light emitting surface 431*b* of the light guides 431.

The upper substrate 430 comprises an external light shielding member 432 formed in a direction perpendicular to the address electrodes 211 between the light guides 431, for preventing external light from being introduced into the discharge cells 214. Due to the external light shielding member 432, external light can be more effectively prevented from being introduced into the discharge cells 214, thereby capable of enhancing the bright room contrast. The external light shielding member 432 may include a conductive film for shielding electromagnetic interference (EMI).

First and second discharge electrodes 221*a* and 221*b* for sustaining a discharge are formed in the direction perpendicular to the address electrodes 211. Also, first and second bus electrodes 222*a* and 222*b* are formed of a metal material on lower surfaces of the first and second discharge electrodes 221*a* and 221*b*.

A second dielectric layer 223 is formed on a lower surface of the upper substrate 430 so as to cover the first and second discharge electrodes 221*a* and 221*b* and the first and second bus electrodes 222*a* and 222*b*. A protective layer 224 is formed on a lower surface of the second dielectric layer 223.

Figure 9:
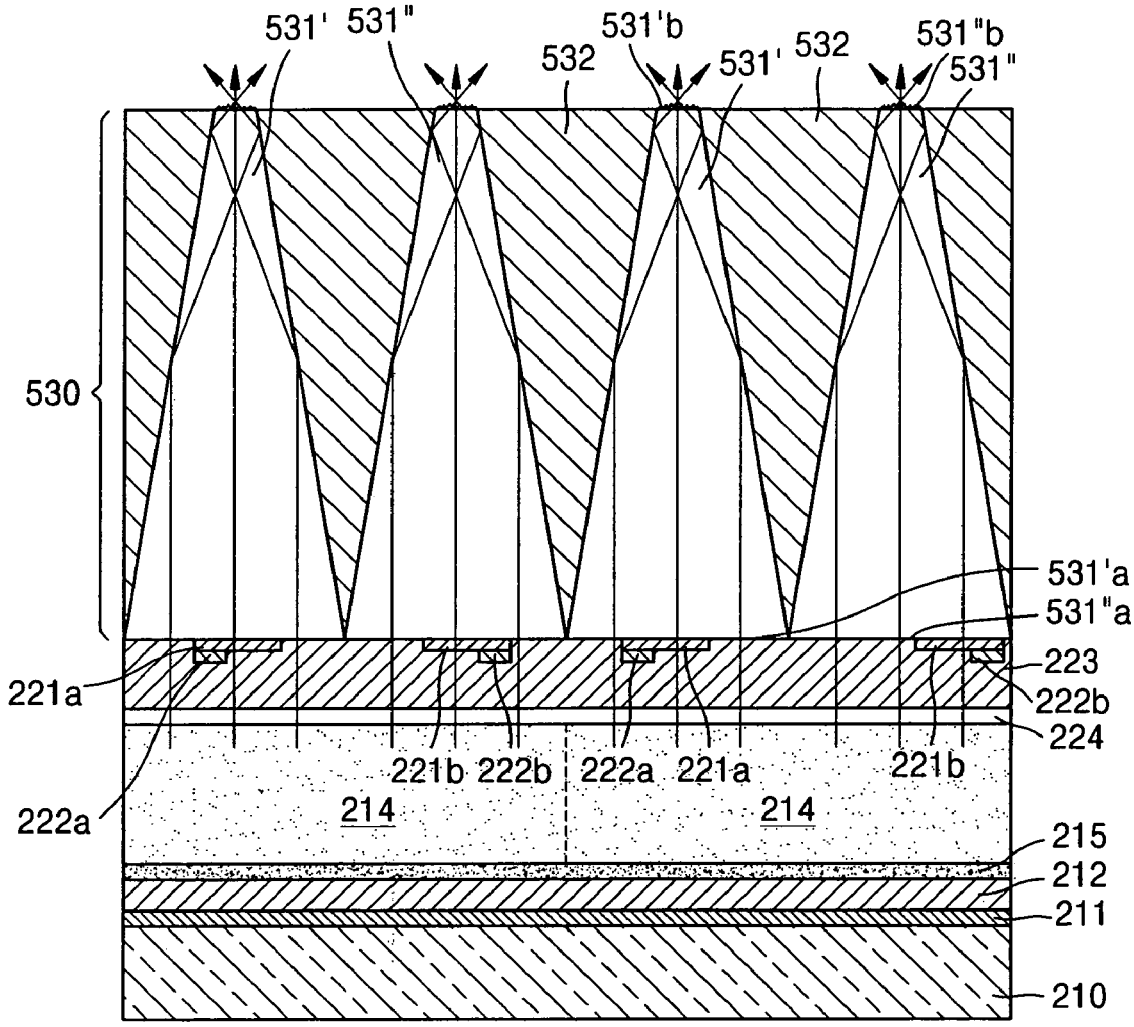
FIG. 9 is a cross-sectional view illustrating a modification of the PDP of FIG. 7.

FIG. 9 is a cross-sectional view illustrating a modification of the PDP of FIGS. 7 and 8. Referring to FIG. 9, two light guides 531' and 531" for focusing and outputting visible light generated in discharge cells 214 are formed corresponding to one discharge cell 214 in a direction perpendicular to the address electrodes 211. The respective light guides 531' and 531" have light incident surfaces 531'*a* and 531"*a*, which are larger in area than light emitting surfaces 531'*b* and 531"*b*. Internal surfaces extend between the light incident surfaces 531'*a* and 531"*a* and light emitting surfaces 531'*b* and 531"*b* to internally reflect light. Although FIG. 9 shows two light guides 531' and 531" corresponding to one discharge cell 214 being formed, three or more light guides may be formed corresponding to one discharge cell 214 unlike in FIG. 9. Preferably, the light emitting surfaces 531'*b* and 531"*b* of the light guides 531' and 531" are non-glare treated. Thus, if two or more light guides are formed corresponding to one discharge cell, loss of the visible light generated in the discharge cells can be reduced and the light integrity can also be enhanced, thereby further enhancing the brightness of the panel.

Additionally, an external light shielding member 532 for preventing external light from being introduced into the discharge cells 214 is formed between the light guides 531' and 531". Accordingly, the bright room contrast of the panel is further enhanced. The external light shielding member 532 may include a conductive film for shielding electromagnetic interference (EMI).

Figure 10:
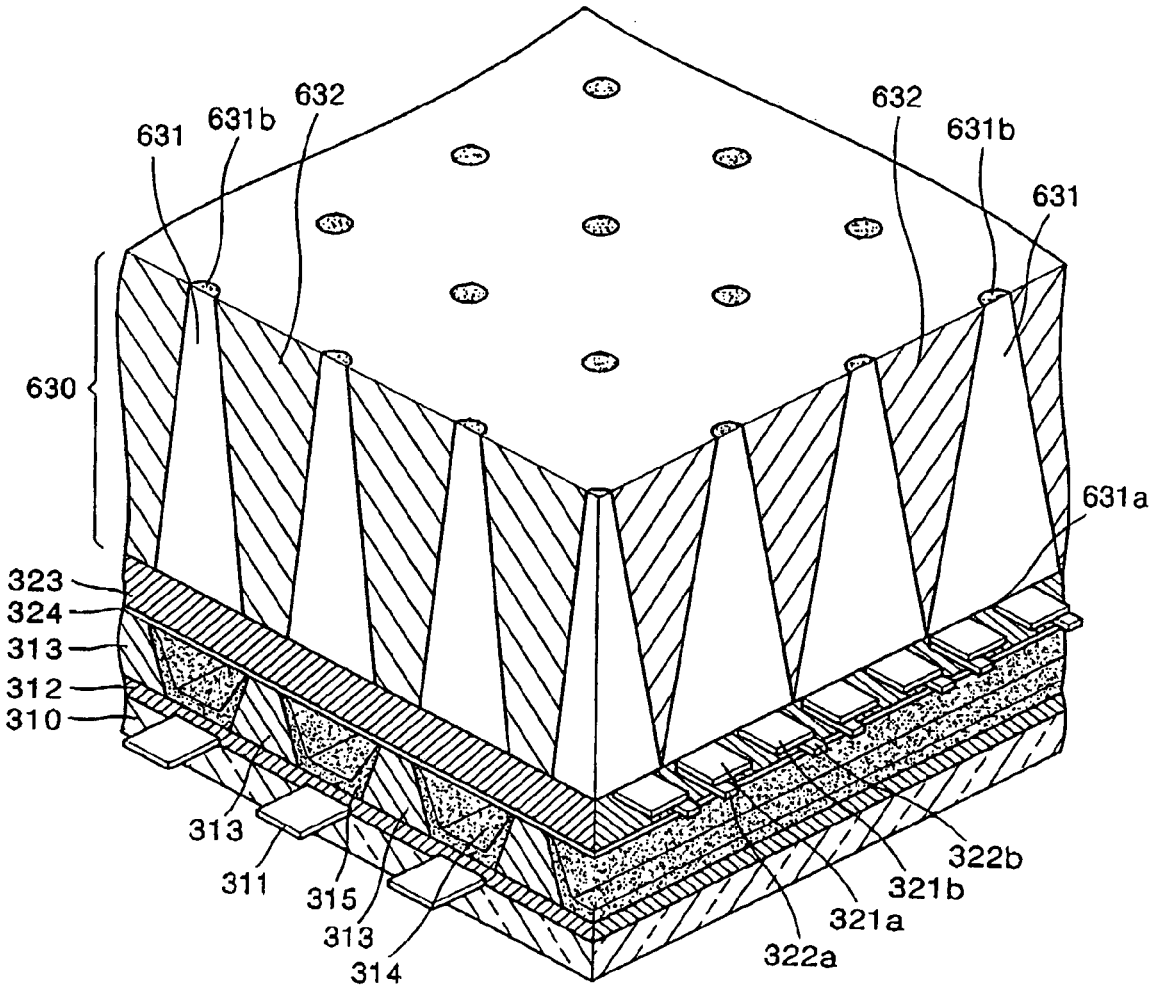
FIG. 10 is a partial cut-away perspective view of a PDP according to yet another embodiment of the present invention.
Figure 11:
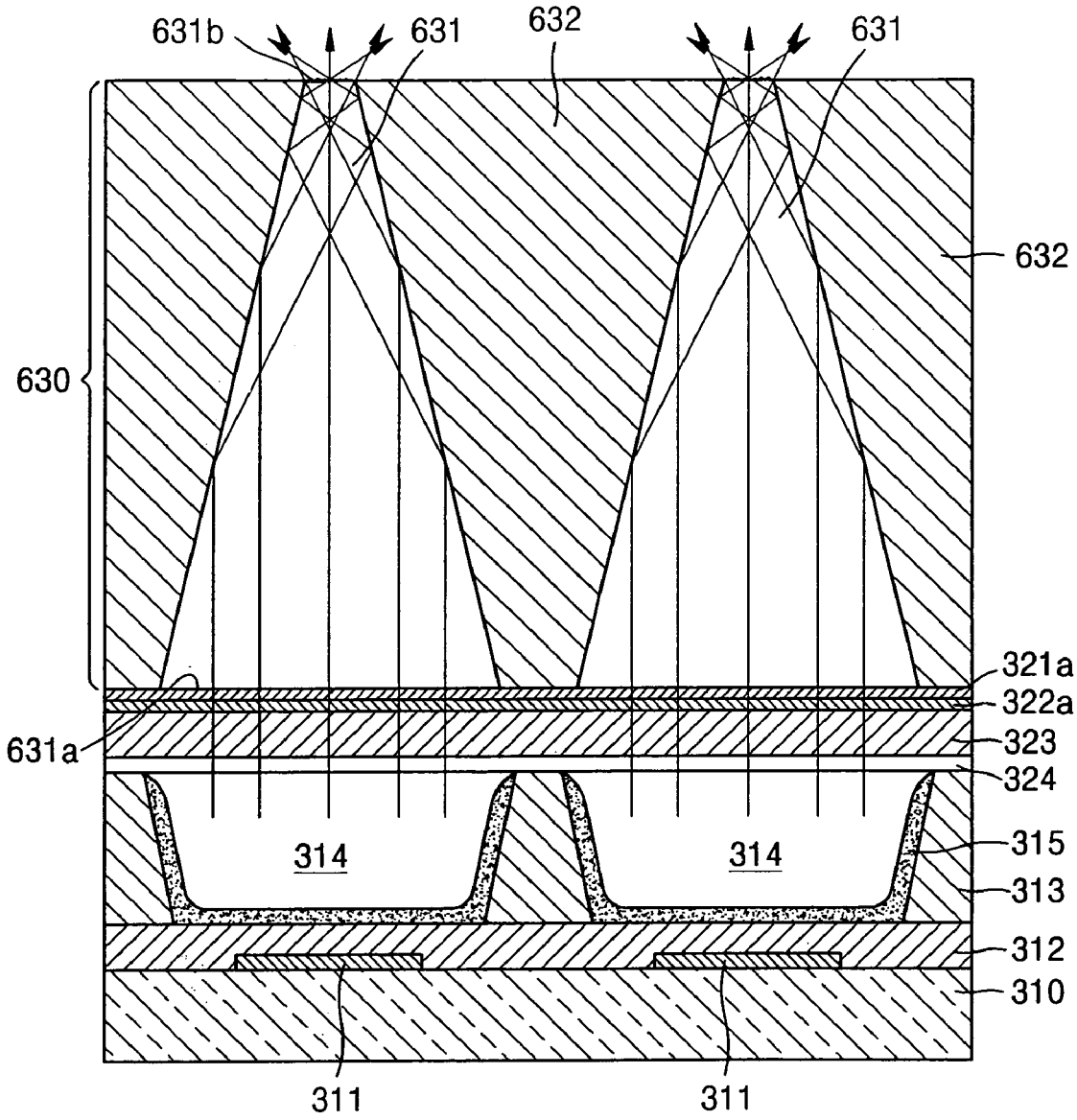
FIGS. 11 and 12 are cross-sectional views illustrating an inner structure of the PDP of FIG. 10.
Figure 12:
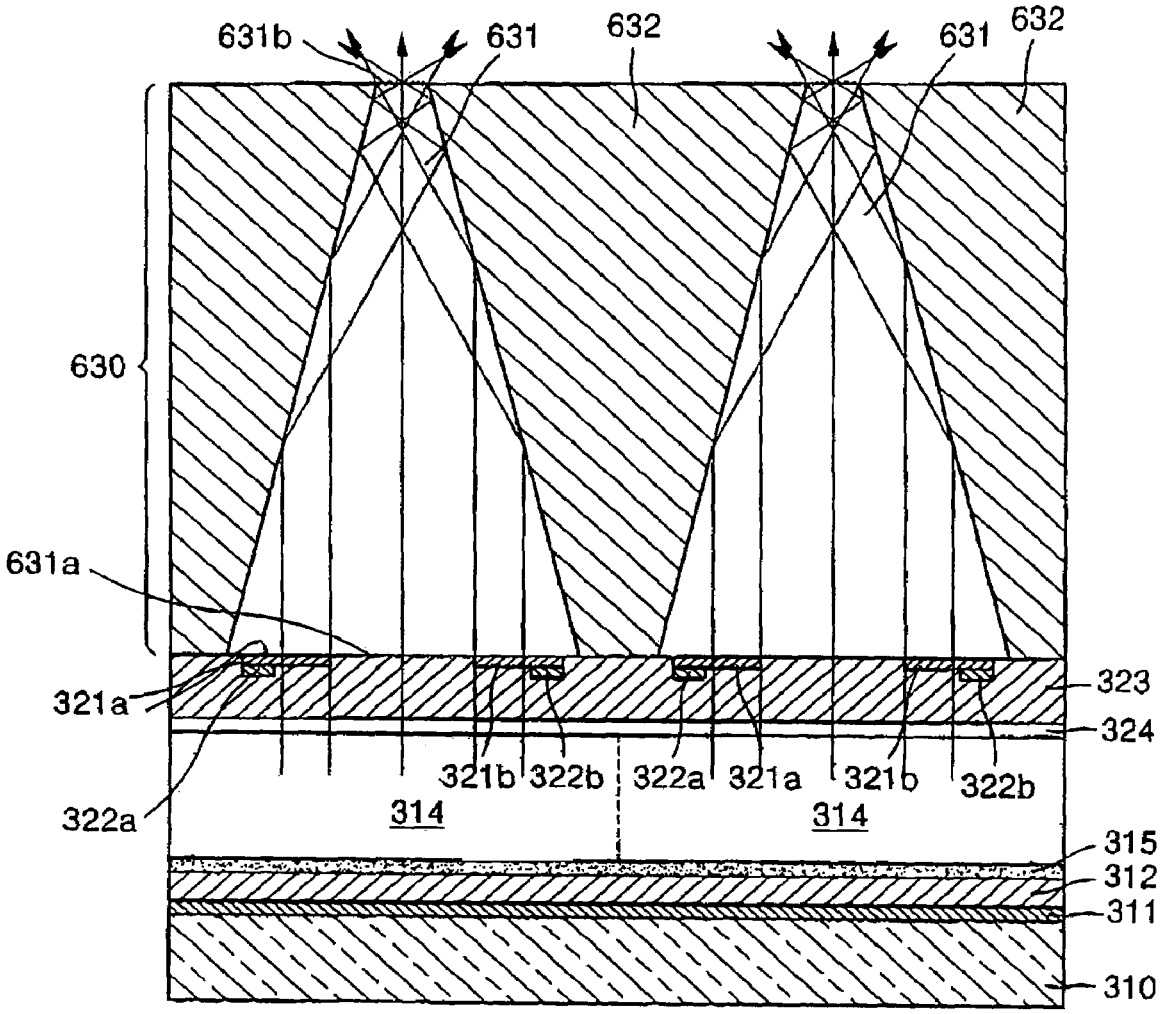

FIG. 10 is a partial cutaway perspective view of a PDP according to another embodiment of the present invention, and FIGS. 11 and 12 are sectional views illustrating an inner structure of the PDP of FIG. 10.

Referring to FIGS. 10 through 12, a lower substrate 310 and an upper substrate 630 are spaced apart from each other, and a plurality of discharge cells 314 are formed between the lower substrate 310 and the upper substrate 630. A plurality of address electrodes 311 and a first dielectric layer 312 are sequentially formed on an upper surface of the lower substrate 310. A plurality of barrier ribs 313 are formed in parallel with the address electrodes 311 on an upper surface of the first dielectric layer 312. A fluorescent layer 315 is deposited on an upper surface of the first dielectric layer 312, and side surfaces of the barrier ribs 313 forming inner walls of the discharge cells 314. A discharge gas is filled inside the discharge cells 314.

The upper substrate 630 comprises a plurality of light guides 631, which are formed corresponding to the respective discharge cells 314 to focus and output visible light generated by a discharge. Each of the light guides 631 is designed to reflect light from a surface thereof and to induce the light to a light incident surface 631*a* to be emitted through a light emitting surface 631*b*. Also, each of the light guides 631 has the light incident surface 631*a*, which is larger in area than the light emitting surface 631*b*. An internal surface extends between the light incident surface 331*a* and the light emitting surface 331*b* to internally reflect light. At this point, each of the light guides 631 may be formed in a conical shape, a pyramidal shape or other various shapes. The light guides 631 focus visible light generated in the discharge cells 314 and outputs the focused visible light to the outside, so that loss of visible light is reduced, thereby enhancing the brightness of the panel. Preferably, the light emitting surfaces 631*b* of the light guides 631 are non-glare treated.

The upper substrate 630 further comprises an external light shielding member 632, which is formed between the light guides 631, prevents external light from being introduced into the discharge cells 314. In the present embodiment, since the external light shielding member 632 can be formed on a wider area on the upper substrate 630 than that in the previous embodiment, the bright room contrast of the panel is further enhanced. The external light shielding member 632 can include a conductive film for shielding electromagnetic interference (EMI).

First and second discharge electrodes 321*a* and 321*b* for sustaining a discharge are preferably formed on a lower surface of the upper substrate 630 in the direction perpendicular to the address electrodes 311. Also, first and second bus electrodes 322*a* and 322*b* are formed of a metal material on lower surfaces of the first and second discharge electrodes 321*a* and 321*b*.

A second dielectric layer 323 is formed on a lower surface of the upper substrate 630 so as to cover the first and second discharge electrodes 321*a* and 321*b* and the first and second bus electrodes 322*a* and 322*b*. A protective layer 324 is formed on a lower surface of the second dielectric layer 323.

As described above, the PDP according to an embodiment of the present invention has the following effects:

First, light guides each having a light incident surface, which is larger in area than a light emitting surface, are formed on an upper surface, so that loss of visible light generated by a discharge can be reduced, thereby enhancing the brightness of the panel.

Second, since an external light shielding member is formed between light guides, so that external light can be prevented from being introduced into discharge cells, thereby enhancing the bright room contrast.

Third, since light guides can be made at a width less than a few tens of μm, they can be employed in the resolution of XGA or SXGA level, thereby being capable of realizing a high definition image.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel comprising:

a lower substrate and an upper substrate, which are spaced apart by a predetermined distance from each other to define a plurality of discharge cells therebetween;

a plurality of barrier ribs disposed between the lower substrate and the upper substrate;

a plurality of address electrodes formed in parallel with one another on an upper surface of the lower substrate;

a plurality of discharge electrodes formed in a direction crossing the address electrodes on a lower surface of the upper substrate; and a fluorescent layer formed on an inner wall of the discharge cells, wherein the upper substrate comprises a plurality of light guides, which are formed corresponding to said plurality of address electrodes or said plurality of discharge cells, the light guides having a light incident surface, which is larger in area than a light emitting surface thereof, the light guides having an internal surface for internally reflecting light to focus and output visible light generated from the discharge cells out of the light emitting surface.

2. The plasma display panel of claim 1, wherein each of the light guides is formed corresponding to each of the discharge cells.

3. The plasma display panel of claim 1, wherein there are at least two light guides formed corresponding to each of the discharge cells.

4. The plasma display panel of claim 1, wherein each of the light guides is formed corresponding to the two or more of the discharge cells.

5. The plasma display panel of claim 4, wherein each of the light guides is formed corresponding to three of the discharge cells, wherein the three discharge cells forming a unit pixel.

6. The plasma display panel of claim 1, wherein the upper substrate comprises an external light shielding member formed between the light guides, for preventing an external light from being introduced into the discharge cells.

7. The plasma display panel of claim 6, wherein the external light shielding member comprises a conductive film for shielding electromagnetic interference.

8. The plasma display panel of claim 1, wherein the light emitting surfaces of the light guides are non-glare treated.

9. The plasma display panel of claim 1, wherein the barrier ribs are formed in parallel with the address electrodes.

10. The plasma display panel of claim 1, wherein a plurality of bus electrodes are formed on lower surfaces of the discharge electrodes.

11. The plasma display panel of claim 1, wherein a first dielectric layer is formed on an upper surface of the lower substrate to cover the address electrodes.

12. The plasma display panel of claim 11, wherein a second dielectric layer is formed on a lower surface of the upper substrate to cover the discharge electrodes.

13. The plasma display panel of claim 12, wherein a protective layer is formed on a lower surface of the second dielectric layer.

14. The plasma display panel of claim 1, wherein the plurality of light guides are formed in parallel with the plurality of address electrodes.

15. The plasma display panel of claim 1, wherein the plurality of light guides are formed in a direction perpendicular to the plurality of address electrodes.

16. The plasma display panel of claim 1, wherein the light guides have a conical shape.

17. The plasma display panel of claim 1, wherein the light guides have a pyramidal shape.

18. The plasma display panel of claim 1, wherein the light incident surface is substantially planar.

19. A plasma display panel comprising:

a lower substrate;

an upper substrate spaced apart from the lower substrate to define a plurality of discharge cells between the lower and upper substrates, each discharge cell being adapted to emit light when the cell is discharged; and a plurality of light guides disposed in the upper substrate for receiving light discharged from the discharge cells, each light guide having a substantially planar light incident surface and a light emitting surface, the light emitting surface being smaller than the light incident surface, wherein the light guides have an internal surface for internally reflecting light to focus and output light incident upon the light incident surface out of the light emitting surface.

20. The plasma display panel of claim 19, wherein the light guides have a conical shape.

21. The plasma display panel of claim 19, wherein the light guides have a pyramidal shape.

* * * * *